United States Patent [19]

Pippin, Jr.

[11] 3,965,611

[45] June 29, 1976

[54] DIRECTIONALLY STABLE REACTION-FLUID-PROPELLED CARRIER MISSILE WITH FLUID-SEALED MOVABLE RETENTION AND RELEASE WALL

[76] Inventor: Reginald F. Pippin, Jr., 7806 Ruxway Road, Towson, Md. 21204

[22] Filed: Apr. 16, 1974

[21] Appl. No.: 461,367

Related U.S. Application Data

[60] Division of Ser. No. 228,279, Feb. 22, 1972, which is a division of Ser. No. 36,120, May 11, 1970, Pat. No. 3,646,702, which is a continuation-in-part of Ser. No. 504,299, Oct. 24, 1965, Pat. No. 3,510,980.

[52] U.S. Cl. ..... 46/74 B; 46/86 A

[51] Int. Cl.[2] ..... A63H 27/00; A63H 33/20

[58] Field of Search ..... 46/74 R, 74 B, 86 A

[56] References Cited

UNITED STATES PATENTS 3,803,751 4/1974 Pippin ..... 46/74 B

*Primary Examiner*—Louis G. Mancene
*Assistant Examiner*—Robert F. Cutting

[57] ABSTRACT

A missile arrangement including a self-propelled carrier missile unit and one or more releasably held secondary units releasable from their held condition, the self-propelled missile unit having a fluid discharge orifice and a pressurizable substantially fluid-tight fluid-pressure-responsively movable retention and release wall, which enables retention and release of the separable unit by respectively fluid-pressurizing and depressurizing the self-propelled unit. The wall is resiliently urged toward a release position. Several embodiments of a preferred fluid-sealed fluid-pressure-responsively movable retention and release wall, in the form of a flexible diaphragm retention and release wall, are illustrated.

25 Claims, 10 Drawing Figures

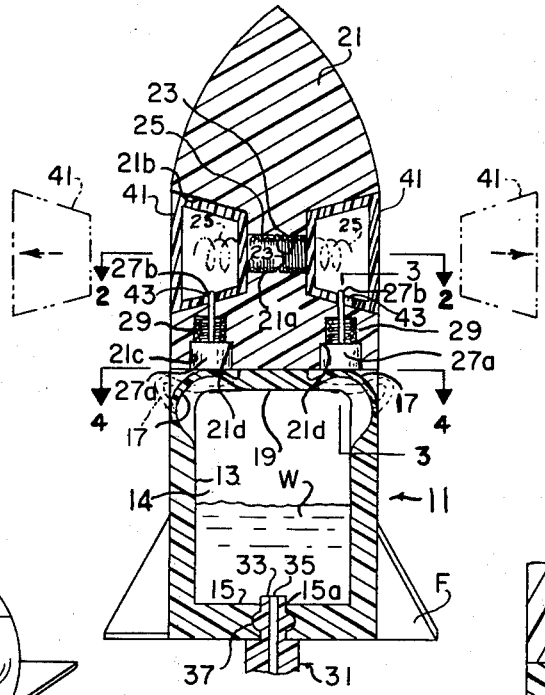
FIG. 1
FIG. 4
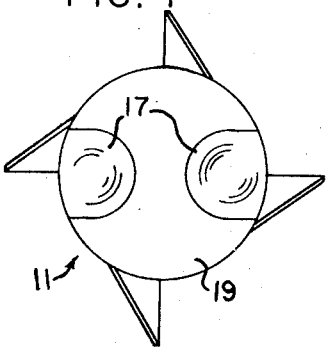
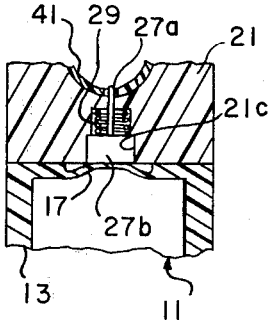
FIG. 3
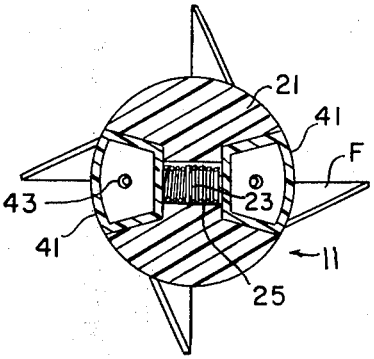
FIG. 2
FIG. 5
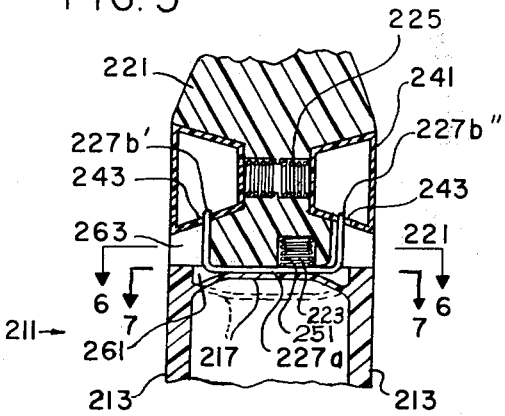

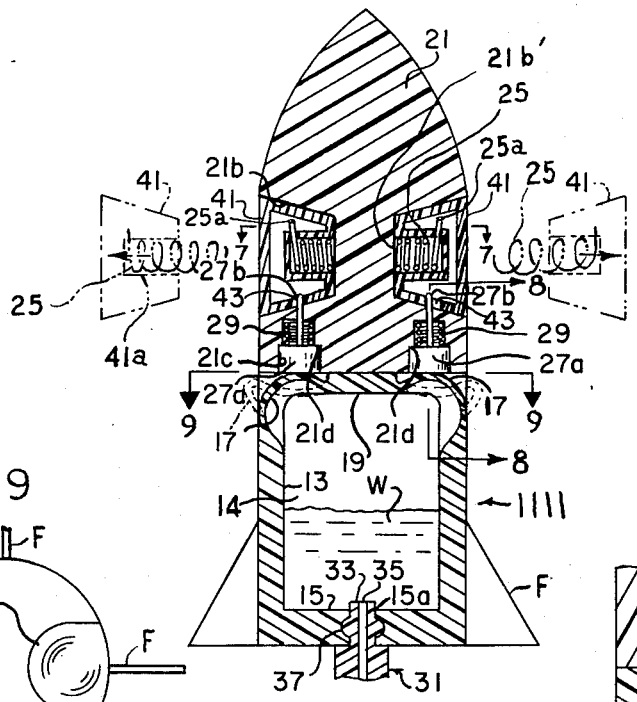
FIG. 6
FIG. 9
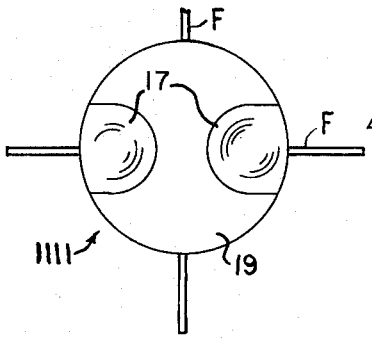
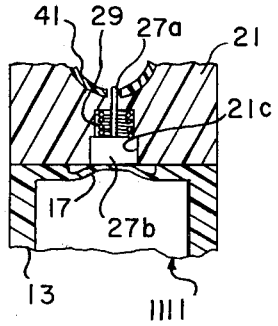
FIG. 8
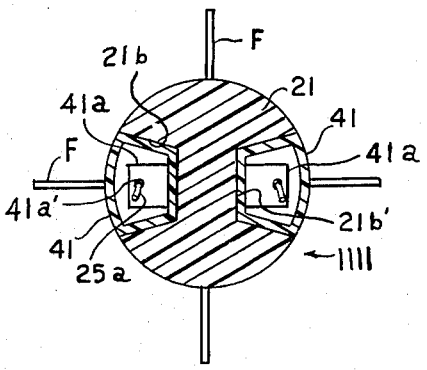
FIG. 7
FIG. 10
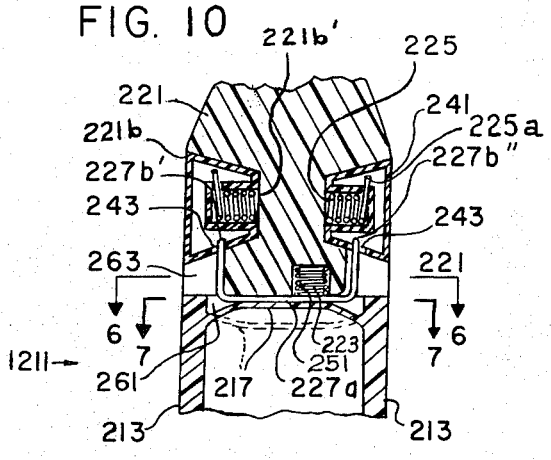

DIRECTIONALLY STABLE REACTION-FLUID-PROPELLED CARRIER MISSILE WITH FLUID-SEALED MOVABLE RETENTION AND RELEASE WALL

This application is a divisional application of my copending application Ser. No. 228,279, filed Feb. 22, 1972, which in turn is a divisional application of application Ser. No. 36,120, filed May 11, 1970, now U.S. Pat. No. 3,646,702, which in turn is a continuation-in-part of application Ser. No. 504,299, filed Oct. 24, 1965, now U.S. Pat. No. 3,510,980, dated May 12, 1970.

This invention relates to a propelled toy arrangement, and more particularly to a fluid-pressurized carrier missile arrangement, which takes the form of a reaction propelled carrier missile unit which effects retention and subsequent release of one or more releasably held units after decrease of fluid pressure in the self-propelled missile unit.

It is a feature of the invention to provide a generally rigidbodied directionally stable self-propelled toy missile carrier unit which is useful in a multi-unit toy missile arrangement in which a carryable secondary unit or member may be retained by and released from a retained position by the self-propelled carrier missile unit of this invention and patent, as a function of pressurization and depressurization movement and positioning of a substantially fluid-sealed fluid-pressurizably-movable retention and release wall of the claimed carrier missile unit invention. The fluid-sealed fluid-pressurizably-movable retention and release wall is illustrated in the preferred form of a flexible diaphragm wall which affords a fluid-sealed pressure-responsively movable retention and release wall for a carryable secondary unit or member desired to be retained or held in a desired quiescent carried condition during an initial portion of flight and to be released for a selected purpose or function of the carryable secondary unit or member, as may be desired, upon traversing an initial portion of the flight.

Still other objects, features and attendant advantages will become apparent to those skilled in the art from a reading of the following detailed description of several physical embodiments according to the invention, taken in conjunction with the accompanying drawings wherein:

FIG. 1 is a longitudinal section view of a propelled toy rocket launcher and satellite missile embodiment according to the invention, FIG. 2 is a cross-section view taken on line 2—2 of FIG. 1, FIG. 3 is a section view taken on line 3—3 of FIG. 1, FIG. 4 is a section view taken on line 4—4 of FIG. 1, FIG. 5 is a fragmentary section view of a modified missile holding and release arrangement, FIGS. 6–9 are views similar to FIGS. 1–4, illustrating a further modification, FIG. 10 is a view similar to FIG. 5, illustrating still a further modification.

Referring now to the drawings, in FIG. 1 is shown a self-propelled liquid ejection type reaction motor toy carrier unit 11 having a pressurizable liquid storage chamber 14 enclosed by annular sidewall 13, rear end wall 15 and forward end wall 17, 19. Various suitable materials may be used, considering the required functions of the parts, including rubber or plastics such as nylon, polyethylene, Delrin, acetal resin, polypropylene, etc. As in prior rocket toys of this general type the storage chamber 14 may be loaded through a discharge orifice with a charge of fuel in the form of liquid such as water W, and the chamber is subsequently pressurized and launched, normally in a generally vertical direction, from a suitable launcher. Various ground or initial launching arrangements may be used, such as that shown in the Holderer U.S. Pat. No. 3,046,694, or Krautkrawer U.S. Pat. No. 2,732,657. The Holderer-type launcher is shown for purposes of illustration at 31, and is preferable since it is pressure-responsively self-releasing in action. This type launcher 31 includes a nodule detent 37 in an orifice-sealing stem 33 having a pressurizing bore 35 through which air and/or water may be pumped to effect desired pressurization of chamber 14, and subsequent self-release of the rocket 11 upon build-up of pressure beyond a given value within the chamber 14. Propulsion of the carrier unit 11 is effected by reaction from the discharge of liquid from the chamber 14 through orifice 15*a*, and in the illustrated and proferred embodiments stabilization of the rocket is effected by fins F, which are canted in the embodiment of FIGS.1–4, to provide spin stabilization and other effects such as aiding in the launching of the satellites as will be described hereinafter.

The nose section 21, which is preferably separately formed from the lower section 13, 15, 17, 19 for ease of molding, may be secured to the lower section as by suitable adhesive, spin welding, etc., through a face junction with the upper surface of rigid wall section 19.

Reaction propellant carrier unit 11 forms a self-propelled carrier for one or more carryable units or members which take the form of two secondary launchable satellite missiles in the illustrated embodiment, and to this end reaction propelled carrier unit 11 in the illustrative embodiment carries two "satellite", "space capsule", or "space ship" missile members 41, the shape of which may be as desired, but which is preferably frusto-conical with a plano-convex outer base end conforming to the general curvature of the adjoining outer surface of a nose section 21. This general shape enables advantageous holding and launching and has the added feature of resembling the general shape of early nammed space capsules which are well remembered by children who may use this toy. The satellites 41 are each releasably held in their respective complementary female opening 21*b* by satellite missile retaining means which in the illustrative and preferred embodiment takes the form of positive retention flexibly movable diaphragm wall which is urged into satellite missile retaining position by positive pressure in the liquid fuel storage chamber 14. In the illustrated embodiment each of these flexibly movable retention control wall diaphragms 17 acts to retain and release its respective missile unit 41 through an intermediary detent arrangement, although each may be directly effected through suitable modification. The detent arrangement takes the form of detent plungers riding in a respective guide bore 21*c* and having an enlarged lower end 27*a* and a smaller diameter detent end 27*b* which engages with a hole or recess 43 formed in the wall of satellite missile 41. Compression springs 29 resiliently urge the detents away from satellite holding position, while positive pressure within chamber 14 effects movement of the detents upwardly against the compression springs 29 and toward engagement with shoulder stops 21*d* to effect holding engagement with the satellites 41, as shown in FIGS. 1 and 3. This upward movement is accomplished through upward flexing and expanding movement of flexible diaphragm sections 17 of the forward wall of chamber 14. Upon reduction of pressure in the chamber 14 below a critical leval, as a function of expulsion of the liquid W from the jet orifice 15*a*, the springs 29 will overcome the upward force exerted on the detent plungers 27*a*, 27*b* by the wall diaphragm sections 17 and the detents will be moved downward out of holding engagement with satellites 41, whereupon the satellites will be forcefully propelled outwardly from their respective compartments 21*b*, under the influence of the stored energy in previously compressed compression spring 25, and the centrifugal force exerted on the satellite missiles through the spin imparted to the rocket by canted fins F. If only spring ejection of the satellites is desired then fins F may be made straight as in the embodiment of FIGS. 6–9 to be subsequently described.

Due to the centrifugal ejection forces exerted on the off-axis satellites of FIG. 1 as a result of spin stabilization of the rocket by canted fins F it will be seen that one may also effect launching of the satellites from the rocket without employing spring 25, although this spring is most helpful and desirable in providing for greater launching distance of the satellites than is imparted by centrifugal force alone for a given spin rate. Likewise the spring 25 may be employed without the canted fins, particularly if direct radial or other predetermined straight line propulsion motion of the satellite missile is desired without rotary translatory motion imparted thereto.

A modified arrangement is shown in FIG. 5 in which the spring force is unequal on the two detents for the respective satellite missiles, thereby tending to effect movement of one detent out of holding engagement before the other. The satellite missiles 241 are retained in their compartments against the radially outward action of compressed compression spring 225 as in FIG. 1, through the medium of a common flexible wall diaphragm 217 which releasably moves and holds detents 227*b*′ and 227*b*″ in engagement with respective detent receiving openings 243 in the satellite missiles as a function of pressurization and depressurization of the fluid pressurizable chamber in the rocket carrier and launcher vehicle 211. Detents 227*b*′ and 227*b*″, which may suitably be made of metal for desired strength, move in guide slots 263 and are integrally connected as a unit by an intermediate central connecting section 227*a* which is engaged by a compressed compression spring 251 disposed in a recess 223 above single unitary flexible diaphragm wall 217 and detent connecting section 227*a*. As recess 223 and spring 251 are off center with respect to detent section 227*a* the spring biasing action of spring 251 will be greatest on detent 227*b*″ and this detent will thus tend to be moved down out of holding engagement with its respective satellite 241 before detent 227*b*′, thereby releasing and enabling launching of this respective satellite before the other satellite missile. The unbalanced lateral reaction force exerted by launching a single satellite will cause the rocket to tile or yaw at that time, with probable change of rocket course, and subsequent launching of the other satellite will be along a different path than would have otherwise occurred with simultaneous release and launching.

The modifications of FIGS. 6–9 and 10, respectively, are similar to the embodiments of FIGS. 1–4 and 5, and accordingly do not require extensive description, as most of the elements or parts are the same as in the two previously described embodiments. In each of these two modifications, generally indicated at 1111 and 1211 in FIGS. 6–9 and 10, respectively, releasable storeable energy self-propulsion means is carried by the satellite missiles 41 and 241 respectively. In these illustrative embodiments the releasable storeable energy self-propulsion means takes the form of a compression spring 25 (FIGS. 6–9) and 225*a* (FIG. 10) secured in a well or cavity 41*a* (FIGS. 6–9) 241*a* (FIG. 10) formed in the respective satellite missile 41 and 241. The storeable energy compression spring 24 and 225 may be secured within their respective retention wells or cavities 41*a*, 241*a*, as by a tang extension 25*a*, 225*a* thereon and extending into a retention aperture 41*a*′ (FIG. 7) formed in the wall of well or cavity 41*a*, 241*a* adjacent the base thereof. The springs 25 and 225 may be inserted and secured in their retention wells or cavities 41*a*, 241*a* as by torsionally twisting and pressing such into the respective wells or cavities, and thereupon suitably effectively locking the spring tang extensions 25*a*, 225*a* in the respective retention apertures 41*a*′.

The fins F in the embodiment of FIGS. 6–7 are straight, and the carryable satellite missiles 41 are self-propelled away from the carrier unit missile 13, 21, etc., through the self-propelling action resulting from release of the stored energy of compression of the compressed springs 25, the spring and satellite missile action upon release by detents 27*b* being schematically illustrated in FIG. 6 in phantom lines and by the laterally directed motion arrows. It will, of course, be appreciated that canted fins and centrifugal force propulsion assist may also be used with either of the modifications of FIGS. 6 or 10 if desired, and that other stored energy means than compression springs 25, 225 may be employed within the purview of my invention. In preparing these embodiments for operation, the normally protruding self-propulsion compression springs 25, 225 are compressed into their retention wells 41*a* by end abutting engagement with the inner wall 21*b*′, 221*b*′ of the respective female opening 21*b*, 221*b* of the supporting and carrier unit missile 21, 221 etc., the self-propelled satellite missiles 41, 241 being releasably retained within these female openings 21*b*, 221*b* by the heretofore described action of the pressurizably movable flexible wall diaphragm 17, 217 and associated detent 27, 227. Depressurization of the chamber 14 and associated wall diaphragm enables release and self-propulsion of the satellite carrier unit missiles 41, 241 away from the primary missile forming the supporting and launching base therefor.

While the invention has been illustrated and described with respect to several illustrative physical embodiments thereof, it will be appreciated that various modifications may be made without departing from the scope and spirit of the invention. For instance, the flexible diaphragm wall section(s) could be made of highly elastic material and be self-returnable to a non-expanded position, and by forming the satellite detents on the diaphragm or securing the detents to the movable diaphragm wall sections, or by otherwise forming the flexible wall diaphragm to directly engage and hold the carryable satellite missile or missiles, the desired satellite or other releasable missile retention and release may be derived directly from the diaphragm elasticity or flexibility and with fewer parts. Also, while the carryable satellites are disposed for launching substantially perpendicular to the rocket axis, and such is preferred, it will be apparent that generally other launch directions, both transverse and longitudinal, may be provided for one or more satellite missiles or other launched members. While two carryable satellite missiles are shown and are normally adequate and preferred due to their balancing effect any desired number may be provided within the space available. Additionally, for ease of molding or otherwise forming the parts, the flexible diaphragm wall sections 17, 217, etc., may be separately formed and suitably secured in sealed position as by a suitable cement, adhesive, or welding.

Also, it will be noted and appreciated that the releasably secured carryable unit or member is not claimed in this Patent and does not itself form a part of the invention of this Patent, but only the self-propelled carrier unit per se, and it will thus be further appreciated that the claimed carrier unit invention per se does not require or depend on the employment and carrying of any particular carryable secondary unit or member. Thus, the claimed carrier unit invention may be utilized in conjunction with various other embodiments or forms of carryable fluid-pressure-responsively releasably secured secondary units or members, such as a releasable parachute unit as shown in FIGS. 8 and 9 of the referenced original parent application Ser. No. 504,299, (now U.S. Pat. No. 3,510,980) in which instance the releasable parachute may be, and preferably is, secured as through shroud lines to the claimed self-propelled carrier unit per se of the present patent, or such may be fully separable therefrom. Such parachute unit may, and preferably does, incorporate a fluid-pressure-responsively releasably held retention cover member of suitable construction and configuration, if and as may be desired, one illustrative form of a suitable releasable cover releasably held by a fluid-sealed pressure-responsively movable retention-and-release wall being illustrated in FIGS. 8 and 9 of the referenced parent application Ser. No. 504,299. It will also be appreciated that while other forms of fluid-sealed fluid-pressure-responsive retention-and-release walls may be utilized in the carrier unit, such as a fluid-sealed movable piston wall as shown in said parent application Ser. No. 504,299, the preferred embodiment takes the form of a flexible diaphragm wall. It will thus, be appreciated that the invention is not to be limited by the specific illustrative embodiments but only by the scope of the appended claims.

That which is claimed is:

1. A propelled toy arrangement comprising a self-propelled carrier unit including a generally rigid body having a pressurizable fluid chamber and a fluid discharge orifice in fluid connection between said chamber and the outside atmosphere and being fixed in directional orientation during fluid discharge therethrough, said self-propelled unit having a fluid-sealed fluid-pressure-responsively movable retention-and-release wall in fluid connection with and movable in response to pressure in said chamber, and adapted to releasably hold and carry a carryable unit or member in a first releasably retained condition relative to and by said carrier unit as a function of the retentive positioning of said movable retention-and-release wall in response to internal fluid pressure in said body chamber, and for release of a said carryable unit or member from said first retained condition as a function of movement of said wall to a retracted release position upon decrease of fluid pressure in said chamber.

2. A propelled toy arrangement according to claim 1, said retention-and-release wall comprising a flexible diaphragm wall.

3. A propelled toy arrangement according to claim 2, said diaphragm wall being elastically deformable and self-returnable to a quiescent retracted release condition upon decrease of fluid pressure thereon.

4. A propelled toy arrangement according to claim 2, and a separate spring member opposing retentive movement positioning of said diaphragm wall.

5. A propelled toy arrangement according to claim 2, said flexible diaphragm wall forming a closed flexible wall of said chamber.

6. A propelled toy arrangement according to claim 1, said self-propelled carrier unit having a plurality of spaced apart fluid-sealed fluid pressure-responsively movable retention-and-release walls in fluid connection with and movable in response to pressure in said chamber.

7. A propelled toy arrangement according to claim 6, each of said fluid-sealed fluid-pressure responsively movable retention-and-release walls comprising a flexible diaphragm wall.

8. A propelled toy arrangement according to claim 7, said plural flexible diaphragm walls being integrally interconnected and forming a substantially fluid-tight seal in combination with said generally rigid body.

9. A propelled toy arrangement according to claim 7, and a movable member movable by said wall and releasably engageable with such a said carryable unit or member to effect retention and release of a said releasable carryable unit or member as a function of movement of said wall.

10. A propelled toy arrangement according to claim 9, said movable member being a movable mechanical detent.

11. A propelled toy arrangement according to claim 9, said movable member comprising a slidable piston.

12. A propelled toy arrangement according to claim 1, and latent-energy-releasable means on said self-propelled carrier unit for effecting movement of a said carryable unit or member away from said first releasably retained condition after reduction of internal fluid pressure on said fluid-pressure-responsively movable wall.

13. A propelled toy arrangement according to claim 12, said latent-energy-releasable means comprising a compressible spring secured to said self-propelled carrier unit.

14. A propelled toy arrangement according to claim 13, said compressible spring being a coil spring.

15. A propelled toy arrangement according to claim 13, said diaphragm wall being elastically deformable and self-returnable to a quiescent retracted release condition upon decrease of fluid pressure thereon.

16. A propelled toy arrangement according to claim 13, and a separate spring member opposing retentive movement positioning of said diaphragm wall.

17. A propelled toy arrangement according to claim 13, said flexible diaphragm wall forming a closed flexible wall of said chamber.

18. A propelled toy arrangement according to claim 12, said diaphragm wall being elastically deformable and self-returnable to a quiescent retracted release condition upon decrease of fluid pressure thereon.

19. A propelled toy arrangement according to claim 12, and a separate spring member opposing retentive movement positioning of said diaphragm wall.

20. A propelled toy arrangement according to claim 12, said flexible diaphragm wall forming a closed flexible wall of said chamber.

21. A propelled toy arrangement according to claim 1, and a movable member movable by said wall and releasably engageable with such a said carryable unit or member to effect retention and release of a said releasable carryable unit or member as a function of movement of said wall.

22. A propelled toy arrangement according to claim 21, said movable member being a movable mechanical detent.

23. A propelled toy arrangement according to claim 21, said movable member comprising a slidable plunger.

24. A propelled toy arrangement according to claim 21, and latent-energy-releasable means on said self-propelled carrier unit for effecting movement of a said carryable unit or member away from said first releasably retained condition after reduction of internal fluid pressure on said fluid-pressure-responsively movable wall.

25. A propelled toy arrangement according to claim 24, said latent-energy-releasable means comprising a compressible spring secured to said self-propelled carrier unit.

* * * * *